US007013095B2

(12) United States Patent
Ishida

(10) Patent No.: US 7,013,095 B2
(45) Date of Patent: Mar. 14, 2006

(54) IMAGE FORMING APPARATUS WITH ADJUSTABLE TONER CONTENT IN A DEVELOPING DEVICE BASED ON SURFACE LAYER THICKNESS OF AN IMAGE BEARING MEMBER

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 10/790,838

(22) Filed: Mar. 3, 2004

(65) Prior Publication Data

US 2004/0223776 A1 Nov. 11, 2004

(30) Foreign Application Priority Data

Mar. 7, 2003 (JP) ..... 2003/062593

(51) Int. Cl.
*G03G 15/00* (2006.01)
*G03G 15/08* (2006.01)

(52) U.S. Cl. ..... 399/55; 399/26; 399/49; 399/60

(58) Field of Classification Search ..... 399/55, 399/26

See application file for complete search history.

(56) References Cited

U.S. PATENT DOCUMENTS

| | | | | |
|---|---|---|---|---|
| 5,410,388 | A * | 4/1995 | Pacer et al. | 399/49 |
| 5,485,248 | A | 1/1996 | Yano et al. | 399/73 |
| 5,966,558 | A * | 10/1999 | Kikui | 399/44 |
| 6,014,530 | A * | 1/2000 | Tsunemi | 399/53 |
| 6,160,969 | A * | 12/2000 | Ishigaki et al. | 399/49 |
| 2002/0127026 | A1 * | 9/2002 | Kubota et al. | 399/55 X |
| 2003/0147658 | A1 * | 8/2003 | Shin et al. | 399/26 |

FOREIGN PATENT DOCUMENTS

| | | | |
|---|---|---|---|
| JP | 5-223513 | | 9/1993 |
| JP | 07-191535 | A * | 7/1995 |
| JP | 9-127757 | | 5/1997 |
| JP | 10-232523 | | 9/1998 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member having a surface layer; an electrostatic image forming device for forming an electrostatic image on the surface layer; a developing device, containing at least toner and a carrier, for developing the electrostatic image; a density measuring device for measuring a density of the developed electrostatic image; a layer thickness measuring device for measuring a thickness of the surface layer; and an adjusting device for adjusting toner content in the developing device. The adjusting device adjusts the toner content on the basis of an output of the layer thickness measuring device.

1 Claim, 10 Drawing Sheets

(a)

(b)

IMAGE FORMING APPARATUS WITH ADJUSTABLE TONER CONTENT IN A DEVELOPING DEVICE BASED ON SURFACE LAYER THICKNESS OF AN IMAGE BEARING MEMBER

FIELD OF THE INVENTION AND RELATED ART

The present invention relates to an image forming apparatus, such as a copying machine, utilizing electrophotography or electrostatic recording. Particularly, the present invention relates to means for stabilizing an image density in an image forming apparatus including a so-called two component type developing means using toner and a carrier.

The two component type developing means matches the needs of a market for an image forming apparatus directed to high quality and high speed in recent years and has been widely used.

In the two component type developing, a mixing ratio between the toner and the carrier is changed with consumption of the toner. With the change in mixing ratio, a change in image density and toner scattering are caused to occur. For this reason, the mixing ratio has been measured using an optical mean etc. On the basis of this measurement result, the mixing ratio has been retained to stabilize the image density.

However, even if the mixing ratio between the toner and the carrier is kept at a constant value, the resultant image density has been changed in some cases. This is because a charge amount of the toner is changed due to degradation of the carrier or an environment of the image forming apparatus used.

Thus, such a method that an electrostatic latent image is formed on an image bearing member, developed under predetermined conditions, and subjected to measurement of image density to adjust a mixing ratio between the toner and a carrier, has been used. By such a method, the above mentioned problem such that a resultant image density is not stabilized due to degradation of the carrier and a charge amount of the toner changed depending on an environment of the image forming apparatus used, has been solved.

However, as described in Japanese Laid-Open Patent Application (JP-A) Hei 9-127757, even in the case where the above-mentioned method wherein the density of the latent image developed under the predetermined conditions is measured, is employed, the resultant image density is not stabilized in some cases.

More specifically, with respect to the electrostatic image developed under the same conditions, its density is changed depending on a thickness of a surface layer of an image bearing member. This is because an electric capacitance of the image bearing member is changed depending on the change in thickness of the surface layer of the image bearing member. An amount of attachment of toner holding electric charges is not stabilized with respect to such an image bearing member which is changed in electric capacitance. As a result, the mixing ratio, between the toner and the carrier, which is adjusted based on the density value. For this reason, due to the change in surface layer thickness of the image bearing member, there arises a problem such that a resultant image density is not stabilized.

SUMMARY OF THE INVENTION

An object of the present invention is to prevent an occurrence of such a problem that an image density is not stabilized due to a change in thickness of a surface layer of an image bearing member.

A specific object of the present invention is to provide an image forming apparatus having solved the problem.

According to the present invention, there is provided an image forming apparatus, comprising:

an image bearing member having a surface layer, electrostatic image forming means for forming an electrostatic image on the surface layer, developing means, containing at least toner and a carrier, for developing the electrostatic image, density measuring means for measuring a density of the developed electrostatic image, layer thickness measuring means for measuring a thickness of the surface layer, adjusting means for adjusting toner content in the developing means, wherein the adjusting means adjusts the mixing ratio on the basis of an output of the layer thickness measuring means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
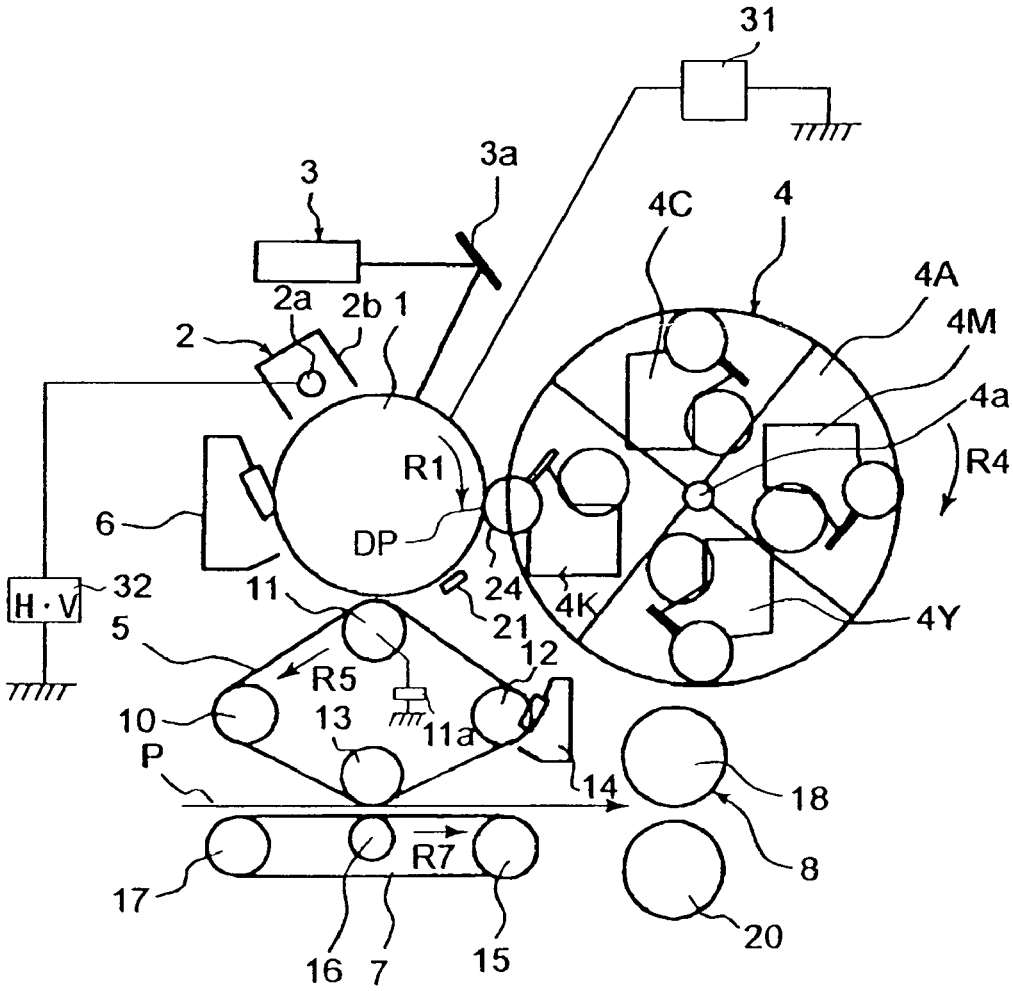
FIG. 1 is a longitudinal sectional view schematically illustrating a general structure of an embodiment of the image forming apparatus according to the present invention.

In the present invention, when an electrostatic image formed on an image bearing member is developed and its image density is measured, a thickness of a surface layer of the image bearing member. Then, depending on its thickness, a difference in electric potential between a voltage applied to a developing means and a potential of the surface layer of a photosensitive drum as the image bearing member, or a target density of the above developed electrostatic image is corrected.

By doing so, such a problem that the image density is not stabilized due to a change in surface layer thickness of the image bearing member, is solved.

Hereinbelow, embodiments of the image forming apparatus according to the present invention will be described more specifically with reference to the drawings.

In the respective drawings, members or means represented by identical reference numerals or symbols have the same structures or functions, and repetitive explanation therefor will be appropriately omitted.

<Embodiment 1>

FIG. 1 show an image forming apparatus according to Embodiment 1 as an embodiment of the image forming apparatus according to the present invention. The image forming apparatus shown in FIG. 1 is a four color-based full-color printer according to an electrophotographic process, and a general structure thereof is schematically illustrated in FIG. 1.

With reference to FIG. 1, a structure of the printer (image forming apparatus) will be described.

Referring to FIG. 1, the image forming apparatus includes a drum-type electrophotographic photosensitive member as an image bearing member (hereinafter, referred to as a "photosensitive drum") 1. The photosensitive drum 1 is supported rotatably in a direction of an arrow R1. Around the photosensitive drum 1, a primary charger (charging means) 2, an exposure apparatus (exposure means 3, a developing apparatus (developing means) 4, an intermediary transfer belt 5, and a cleaning apparatus (cleaning means) 6 are disposed substantially in this order from an upstream side along the rotational direction of the photosensitive drum 1. Further, below the intermediary transfer 5, a transfer conveyance belt 7 is disposed. On a downstream side along a conveyance direction of a recording material P (indicated by an arrow), a fixing apparatus (fixing means) 8 is disposed.

Figure 3:
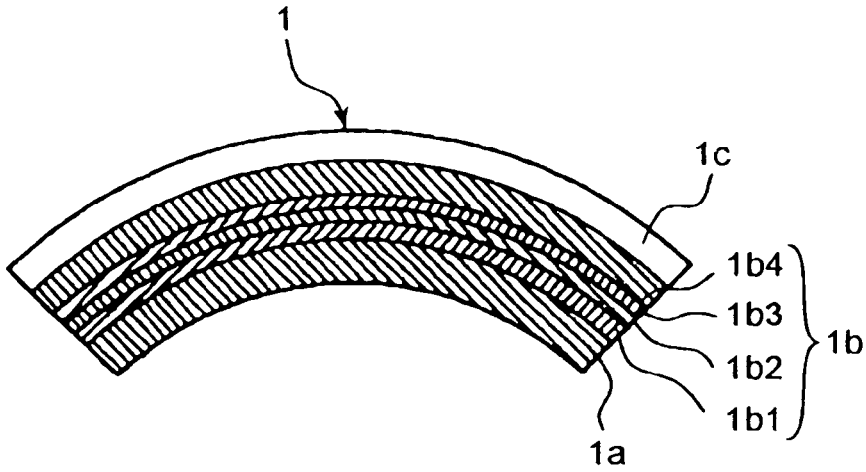
FIG. 3 is a longitudinal sectional view schematically illustrating a layer structure of a photosensitive drum.

In this embodiment, as the photosensitive drum 1, a drum having a diameter of 60 mm is used. The photosensitive drum 1 is, as shown in FIG. 3, prepared by forming a photosensitive layer 1*b* of an ordinary organic photoconductor (OPC) through coating onto an outer peripheral surface of an electroconductive drum support 1*a* of aluminum which is grounded, and forming thereon a protective layer (overcoat layer: OCL) 1*c* excellent in durability through coating. Of these layers, the photosensitive layer 1*b* is constituted by four layers including an undercoating layer (conductive pigment layer: CPL) 1*b*1, an injection prevention layer (undercoat layer: UCL) 1*b*2, a charge generation layer (CGL) 1*b*3, and a charge transport layer (CTL) 1*b*4. The photosensitive layer 1*b* is ordinarily an insulating member and has a property of being changed to an electroconductive member by irradiating it with light of a specific wavelength. This is because holes (electron pair) are generated in the charge generation layer 1*b* and function as an electron charge carrier. The charge generation layer 1*b* is a 0.2 μm-thick layer of a phthalocyanine compound, and the charge transport layer 1*c* is a ca. 2.5 μm-thick layer of polycarbonate in which a hydrazine compound is dispersed. The photosensitive drum 1 is rotationally driven in a direction of an arrow R1 at a predetermined process speed (peripheral speed) by a drive (not shown).

In this embodiment, as the primary charger 2, a scorotron-type corona discharger is used. This corona discharger is formed by coating a discharge wire 2*a* with a metallic shield 2*b* having an opening on the photosensitive drum 1 side.

In this embodiment, a laser scanner effecting ON/OFF action of laser light depending on image information is used as the exposure apparatus 3. The surface of the photosensitive drum 1 after being charged is irradiated with the laser light generated by the exposure apparatus 3 via a reflection mirror 3*a*, whereby electric charges at the laser irradiation portion are removed so as to allow formation of an electrostatic latent image.

In this embodiment, the developing apparatus 4 employs a rotation development scheme. The developing apparatus 4 includes a rotating member 4A rotationally driven about an axis (shaft) 4*a* in a direction of an arrow R4 by a motor (not shown) and four developing devices of black (4K), yellow (4Y), magenta (4M) and cyan (4C) incorporated in the rotating member 4A. When a black developer image (toner image) is formed on the photosensitive drum 1, development is performed at a developing position DP closer to the photosensitive drum 1 by the black developing device 4K. Similarly, when a yellow toner image is formed, the rotating member 4A is rotated 90 degrees to locate the yellow developing device 4Y at the developing position DP to effect development. Formation of a magenta toner image and a cyan toner image is performed in a similar manner. In the following description, the developing devices 4K, 4Y, 4M and 4C are simply referred to as a "developing device" unless their colors are specified particularly.

The above-mentioned intermediary transfer belt 5 is extended around a drive roller 10, a primary transfer roller (primary transfer charger) 11, a driven (follower) roller 12, and a secondary transfer opposite roller 13, and is rotated in a direction of an arrow R5 by rotation of the drive roller 10. A belt cleaner 14 abuts against the intermediary transfer belt 5. The above-described transfer conveyance belt 7 is extended around a drive roller 15, a secondary transfer roller 16 and a driven (follower) roller 17, and is rotated in a direction of an arrow R7 by rotation of the drive roller 15. The described fixing apparatus 8 includes a fixation roller 18 containing therein a heater (not shown), and a pressure roller 20 to be disposed in abutment with the fixation roller from below.

An operation of the above structures image forming apparatus will be described.

Referring to FIG. 1, an electrostatic latent image is formed on the photosensitive drum 1 by exposing the surface of the photosensitive drum 1 to light by the exposure apparatus 3. At this time, to the primary charger 2, a voltage of DC or DC biased with AC is applied from a power source 32. Toner is attached to the electrostatic latent image by a developing device containing a desired color developer (toner), whereby a toner image is formed on the photosensitive drum 1. The toner image is transferred onto the intermediary transfer belt 5 by supplying a primary transfer bias (voltage) from a primary transfer bias power source 11*a*.

In the case of effecting four color-based full color image formation, first of all, a black toner image is formed on the photosensitive drum 1 by the black developing device 4K and primary-transferred onto the intermediary transfer belt 5. Toner (residual toner) remaining on the photosensitive drum 1 surface after the primary transfer is removed by being scraped by an elastic blade provided to the cleaning apparatus 6. Then, the rotation member 4A is rotated 90 degrees, the yellow developing device 4Y is located in the developing position D, and a yellow toner image is formed on the photosensitive drum 1 and primary-transferred and superposed on the black toner image transferred onto the intermediary transfer belt 5.

This operation is successively effected also with respect to the magenta developing device 4M and the cyan developing device 4C, thus superposing four color toner images on the intermediary transfer belt 5. Thereafter, by applying a secondary transfer roller 16, the four color toner images disposed on the intermediary transfer belt 5 are secondary-transferred onto a recording material P held on the transfer conveyer belt 7 at the same time.

The recording material P onto which the toner images are transferred is peeled off the transfer conveyance belt 7 and heated and pressed between the fixation roller 18 and the pressure roller 20 of the fixation apparatus 8, whereby the toner images are fixed on the surface of the recording material P to be formed a a four color-based full color image. Toner (residual toner) remaining on the intermediary transfer belt 5 after the secondary transfer is removed by a belt cleaner 14.

Incidentally, in the case of effecting monocolor image formation, an electrostatic latent image formed on the photosensitive drum 1 is developed by a developing device containing therein a desired color toner. This toner image is, after being transferred onto the intermediary transfer belt 5, immediately secondary-transferred onto the recording material P. The recording material P onto which the toner image is transferred is peeled off the transfer conveyance belt 7 and subjected to heating and pressure by the fixation apparatus 8, whereby the toner image is fixed on the recording material P.

In this embodiment, an image density detection sensor 21 is disposed downstream from the developing position D along the rotation direction of the photosensitive drum 1 and upstream from the primary transfer roller 11 so as to be opposite to the photosensitive drum 1 surface.

The respective color developing devices 4Y, 4M, 4C and 4K incorporated in the rotation member 4A shown in FIG. 1 will be described with reference to FIG. 4.

Figure 4:
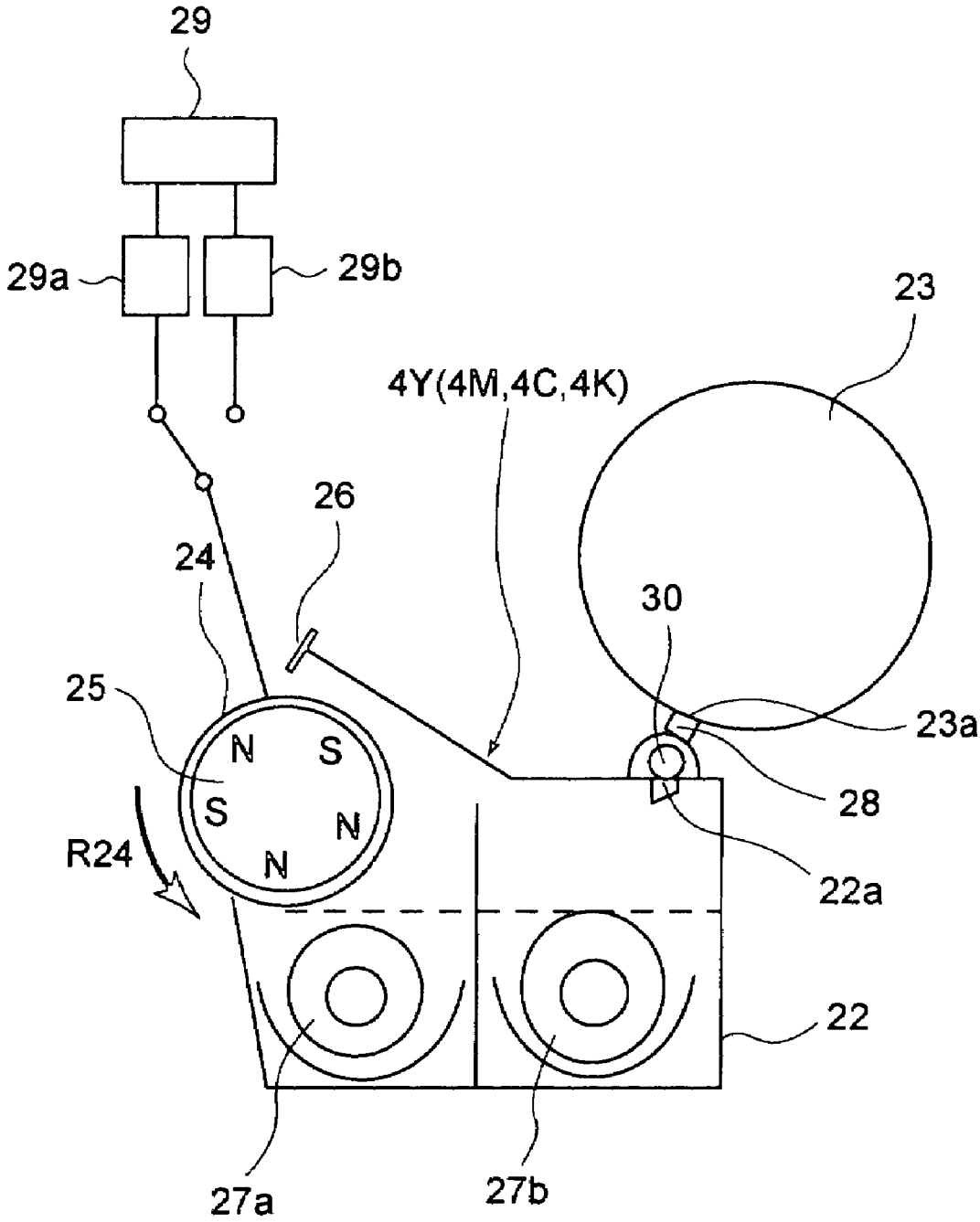
FIG. 4 is a longitudinal sectional view showing structure of a developing device.

Referring to FIG. 4, in a developer container 22 of each developing device, a two component type developer comprising a nonmagnetic toner and a magnetic carrier is accommodated. The developer has a toner content of about 8 wt. % (per its weight (total weight of toner and carrier)) at an initial stage. This toner content, however, should be properly adjusted depending on a structure of the image forming apparatus used, thus being not necessarily constant as about 8 wt. %.

With respect to the toner consumed by development, the developer is replenished with fresh toner from a toner container 23 disposed in the vicinity of and detachably mountable to each developing device of the rotation member 4A.

Wen the developing device is moved to the developing position D, a developing area thereof is opened to the photosensitive drum 1 located opposite thereto, and a developing sleeve 24 is rotatably disposed at the opening so as to be partially exposed at the opening.

Inside of the developing sleeve 24, a fixed magnet 25 as magnetic field generation is disposed. The developing sleeve 24 is formed of a non-magnetic material and rotated in a direction of an arrow R24 shown in FIG. 4, i.e., a gravitational direction (downward direction) in the developing area, whereby the two component type developer in the developer container 22 constituting the developing device is held in a laminar shape and carried to the developing area. As a result the developer is supplied to the developing position D opposite to the photosensitive drum 1 to develop the electrostatic latent image formed on the photosensitive drum 1.

In order to appropriately adjust an amount of developer to be conveyed in the developing area, a regulation blade (developer regulation member) 26 is disposed upstream from the developing area along the rotational direction of the developing sleeve 24 so as to be opposite to the developing sleeve 24. By the regulation blade 26, a layer thickness of the developer on the developing sleeve 24 is regulated.

The developer after developing the electrostatic latent image is conveyed by the rotation of the developing sleeve and recovered within the developing container 22. The developing container 22 includes a first circulation screw 27*a* (closer to the developing sleeve 24) and a second circulation screw 27*b* (on the far side of the developing sleeve 24), as developer stirring/conveyance means. The developer in the developer container 22 is circulated and mixed under stirring by these screws. The circulation direction of the developer is a direction from the back side to the front side of the drawing (FIG. 4) with respect to the first circulation crew 27*a* and a direction from the front side to the back side of the drawing with respect to the second circulation screw 27*b*.

With respect to the above-mentioned developer, the toner component therein is consumed with an increase in the number of sheet of image formation (copying). An amount of toner corresponding to that of the consumed toner is supplied from a developer replenishing port 22*a* to the developer container 22 disposed at the developer container 22 via a developer replenishing port 23*a* and a replenishing conveyance passage 28. The replenished toner is supplied toward stream in the developer conveyance direction container 22, and is mixed under stirring with the developer already present in the developer container 22 and the developer after development conveyed by the first circulation screw 27*a*. The resultant developer is conveyed to the first circulation screw 27*a* in a well-stirred state and then is supplied again to the developing sleeve 24. A replenishing screw 30 (toner replenishing ) is provided in the replenishing conveyance passage 28 and its rotation time is controlled a CPU 29 to adjust a toner amount to be supplied to the developing device.

In this embodiment, the image forming apparatus includes a surface layer thickness detection circuit 31 as a surface layer detection (measuring) means for detecting a thickness of the photosensitive drum 1 in an image forming apparatus main assembly. The surface layer thickness detection circuit 31 detects the surface layer thickness in accordance with such a scheme (current detection scheme) that the surface layer thickness of the photosensitive drum 1 is detected from a current passing through the photosensitive drum 1 when electric charges are removed from the electrically charged photosensitive drum 1.

Figure 2:
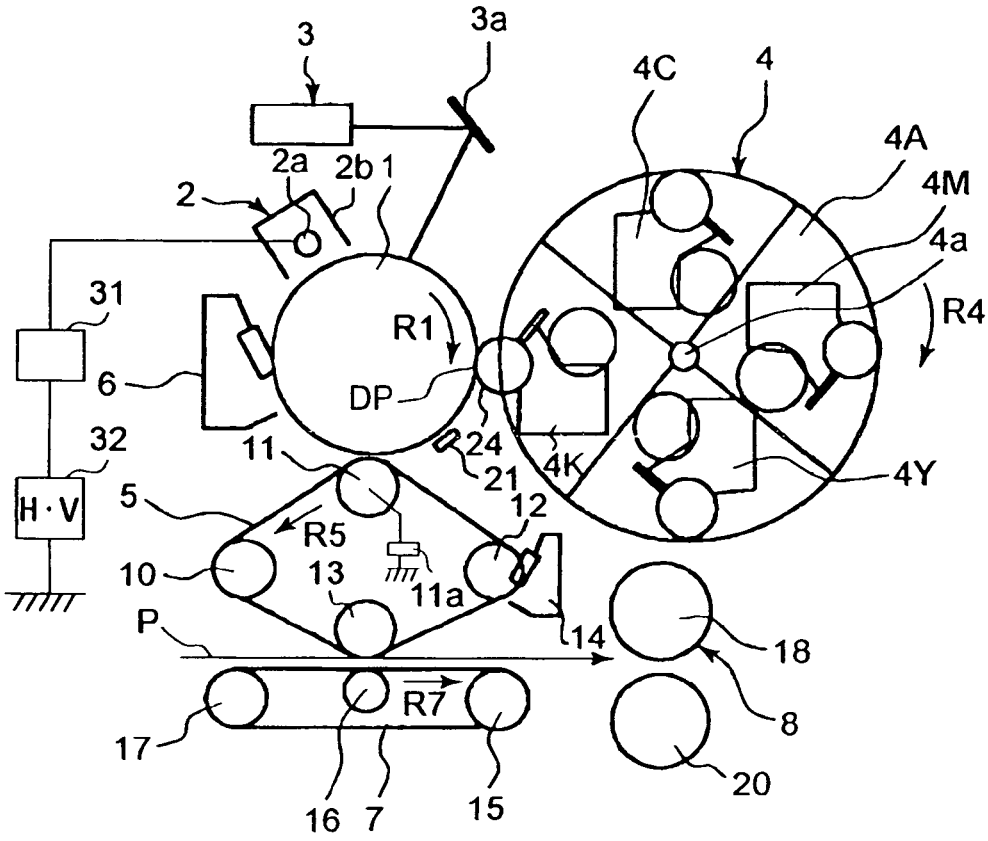
FIG. 2 is a longitudinal sectional view schematically illustrating a general structure of another embodiment of the image forming apparatus of the present invention.

FIG. 2 shows an image forming apparatus including another surface layer thickness detection circuit 31 of the type wherein a current passing through the photosensitive drum 1 is measured at the time when the photosensitive drum 1 is again electrically charged from such a state that electric charged are removed from the photosensitive drum 1.

This current detection scheme is described in detail in, e.g., patent application JP-A Hei 04-056914. (See also Japanese published Patent Document No. 05-223513.) Specifically, a DC current IDC passing through a photosensitive member at the time of increasing a surface potential of the photosensitive member from 0 V to Vd or of increasing the surface potential from Vd to 0 V is represented by the following equation (1):

$$ABS(IDC)=\in\cdot\in 0\cdot L\cdot vp\cdot Vd/d \quad (1),$$

wherein $\in$ represents a relative dielectric constant, $\in 0$ represents a vacuum dielectric constant, L represents an effective charging width of a primary charge roller, vp represents a process speed, and d represents a surface layer thickness of the photosensitive member.

In the above equation, $\in$, $\in p$, L, vp and Vd can be regarded as constants, so that the DC current IDC is found to be inversely proportional to the thickness of the surface layer of the photosensitive member.

Accordingly, by measuring the DC current IDC, it is possible to detect the surface layer thickness of the photosensitive member.

The surface layer thickness detection means in this embodiment applies a charging bias voltage only for a certain period (corresponding to one full turn of the photosensitive drum 1) while rotating the photosensitive drum 1 when the image forming apparatus is turned on. During the period, the DC current is detected 10 times to determine an average thereof IDCave as a final result of current detection (hereinafter, referred to as a "surface layer thickness detection sequence").

Figure 5:
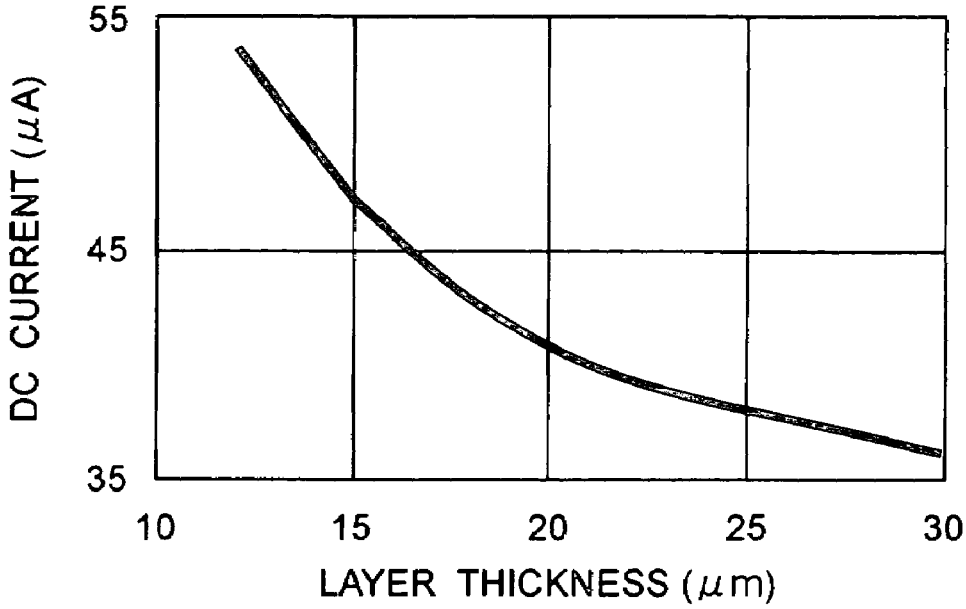
FIG. 5 is a graph showing a relationship between a detected current amount (DC current amount) and a thickness of a surface layer of the photosensitive drum.

FIG. 5 shows a relationship between the surface layer thickness of the photosensitive drum 1 and a detected (DC) current amount.

In this embodiment, the image forming apparatus includes a back-up memory storing a current-surface layer thickness table prepared based on the graph shown in FIG. 5.

Next, a toner patch detection scheme in this embodiment will be described.

On the basis of an environmental table (preliminarily storing set values of process conditions (such as exposure intensity, developing bias voltage and transfer bias voltage) determined depending on temperature/humidity information) stored in the back-up memory and determined in advance, a patch latent image is formed by exposing the charged photosensitive drum 1 to laser light and is developed to form a patch image. This scheme is referred to as a digital patch image scheme. The patch image may be formed by developing a patch latent image at a contrast potential therefor created by a potential difference between the developing bias voltage and a photosensitive drum potential (which is a potential in such an area that the photosensitive drum is charged by the primary charger 2 but is not subjected to light exposure by the exposure apparatus 3) without effecting the laser light exposure to the photosensitive drum 1. This scheme is referred to as an analog patch image scheme. In the case of controlling a toner replenishment amount, as described above, a density of a patch image at the time of initial mounting of the image forming apparatus is detected by an image density detection sensor 21 and its output value is inputted into a CPU (control means, not shown) as a patch target signal value. An amount of toner to be supplied from the toner container 23 to the developer container 23 of developing device is controlled so that the inputted patch target signal value equals to a density of patch image for toner replenishment detected at the time of subsequent density control, i.e., an output value from the sensor.

Incidentally, in this embodiment, a latent image formed through digital exposure is hereinafter referred to as a digital latent image, and an image formed by developing the digital latent image, and an image formed by developing the digital latent image is referred to a digital image. In order to distinguish images, in the case of forming a patch image without using the above-described laser exposure, from the digital latent image and the digital image, a latent image formed without using the laser exposure is referred to as an analog latent image, and an image formed by developing the analog latent image is referred to as an analog image.

However, in the case where the above-described digital patch image scheme is employed, a characteristic of the photosensitive drum 1, particularly a photosensitivity characteristic is changed, in some cases, due to deterioration by use of the photosensitive drum 1 and environmental change thereof, when compared with that at an initial stage. For this reason, an electric potential obtained by exposing the photosensitive drum 1 through laser output of the exposure apparatus 3 and an electric potential to be obtained at the initial stage cause a difference therebetween. As a result, an image density of an image formed on the photosensitive drum 1 is deviated from a desired value by the potential difference. If the image density including this error is used for controlling the amount of replenishment toner, the toner content in the developing device is outside the range of a desired value. Accordingly, there is a possibility that a change in image density and toner fog are caused to occur to result in image failure.

Particularly, with reduction in production cost and apparatus size, the toner replenishment amount is controlled on the basis of a patch image for toner replenishment in such a state that a photosensitive member potential measuring sensor which is an expensive high-performance part is omitted (removed), so that variations in toner content in the developing device becomes large. As a result, loads applied on the toner and the carrier are increased, so that there is a possibility that difficulties including an increase in irregularity image such a fog and a lowering in the life of carrier are caused to occur.

In view of these difficulties, in this embodiment, in order to obviate variations in potential at the laser irradiation portion on the photosensitive drum 1 caused by the change in photosensitivity characteristic of the photosensitive drum 1, the analog patch image scheme wherein a patch latent image for toner replenishment is formed at a stable potential without using the laser exposure and then developed to form a patch image is adopted.

Next, the developing bias voltage in this embodiment will be described.

As shown in FIG. 4, the image forming apparatus of FIG. 1 includes two high-voltage power sources (developing bias application power sources) 29*a* and 29*b* connected to the CPU 29 as the control means. For each developing device, a developing bias voltage A supplied from the high-voltage power source 29*a* and a developing bias voltage B supplied from the high-voltage power source 29*b* can be selectively switched and applied.

Figure 6:
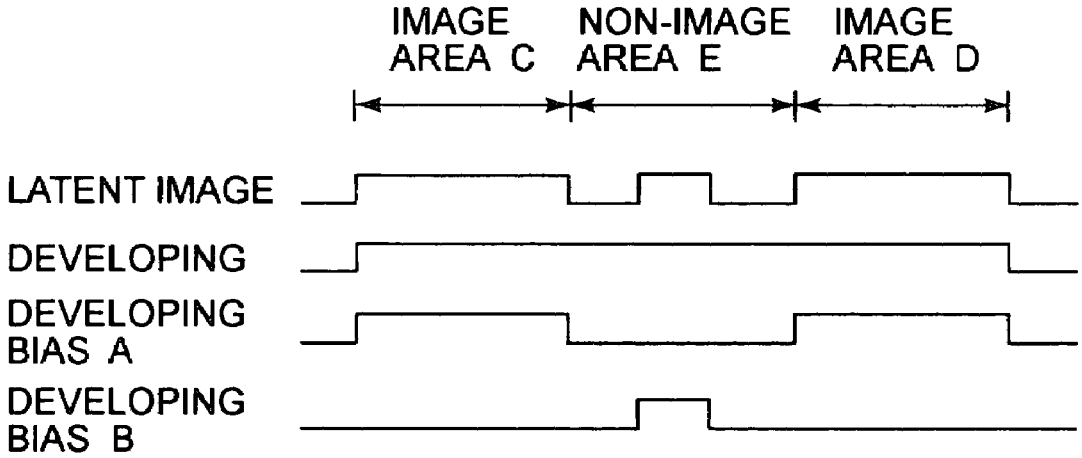
FIG. 6 is a time chart showing switching timing of developing biases.

FIG. 6 shows a timing chart of developing bias voltage switching during image formation.

Referring to FIG. 6, "LATENT IMAGE" represents a period in which a latent image is formed, "DEVELOPING" represents a period in which the developing sleeve 24 is rotated, "DEVELOPING BIAS A" represents a period in which the developing bias voltage A is applied to the developing sleeve 24, and "DEVELOPING BIAS B" represents a period in which the developing bias voltage B is applied to the developing sleeve 24.

Figure 7:
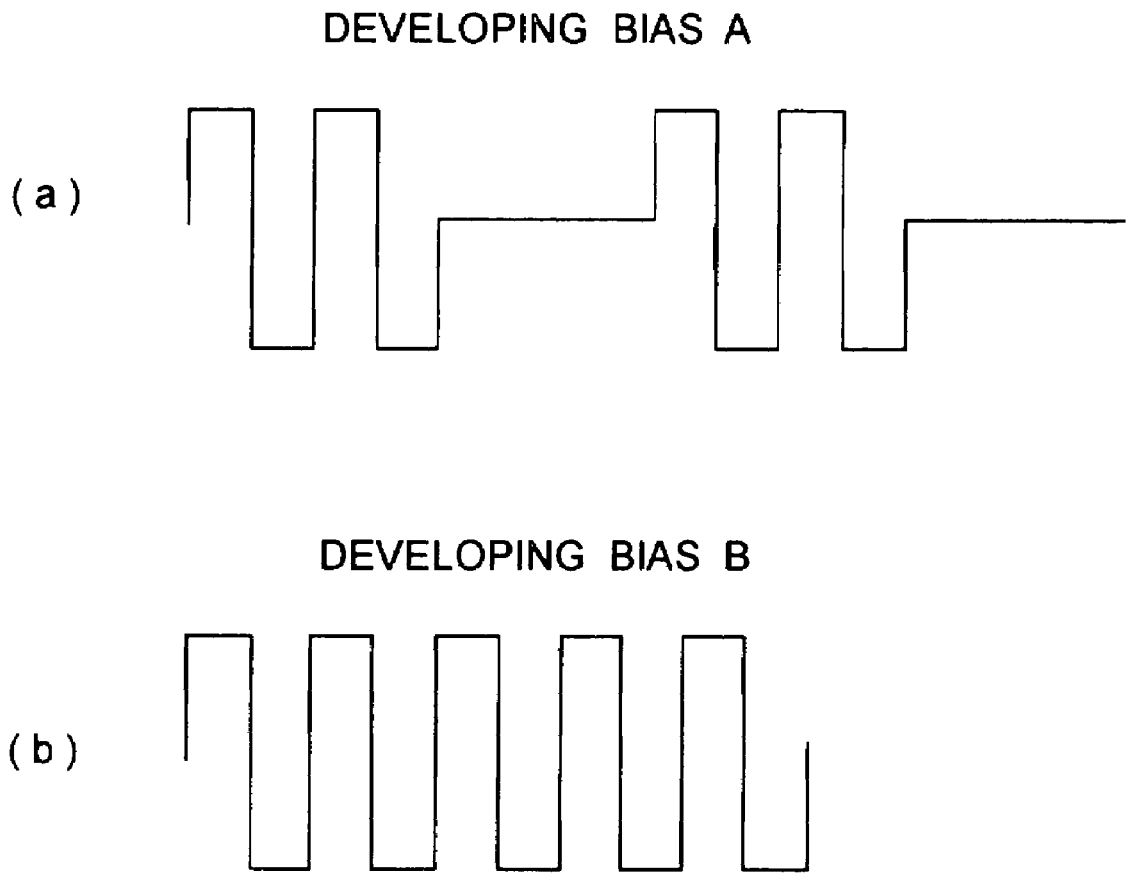
FIGS. 7(*a*) and 7(*b*) are views showing timewise waveforms of developing biases (bias voltages) A and B, respectively.

FIGS. 7(*a*) and 7(*b*) show time waveforms (abscissa: time; ordinate: voltage applied to developing sleeve 24) of the developing bias voltages A and B, respectively, as AC voltages applied to the developing sleeve 24.

Figure 8:
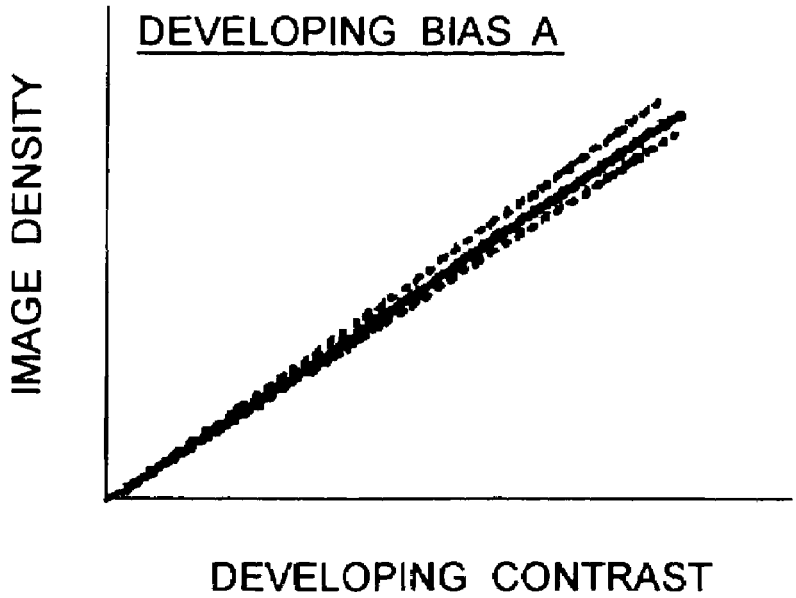
FIGS. 8(*a*) and 8(*b*) are graphs showing developing characteristics of the developing biases A and B, respectively.
Figure 8:
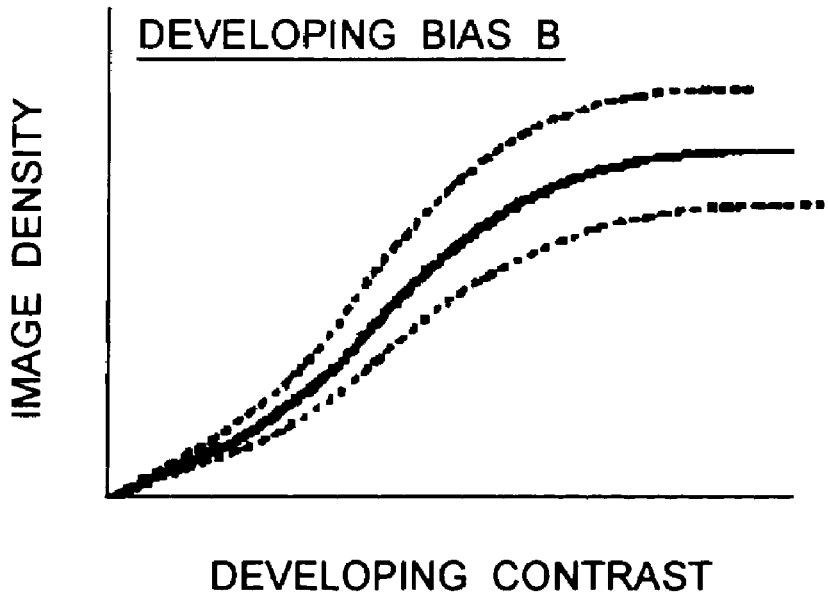

FIGS. 8(*a*) and 8(*b*) show developing characteristics for the developing bias voltages A and B, respectively (abscissa: developing contrast potential (as an absolute value): ordinate: patch image density detected by a sensor).

Figure 9:
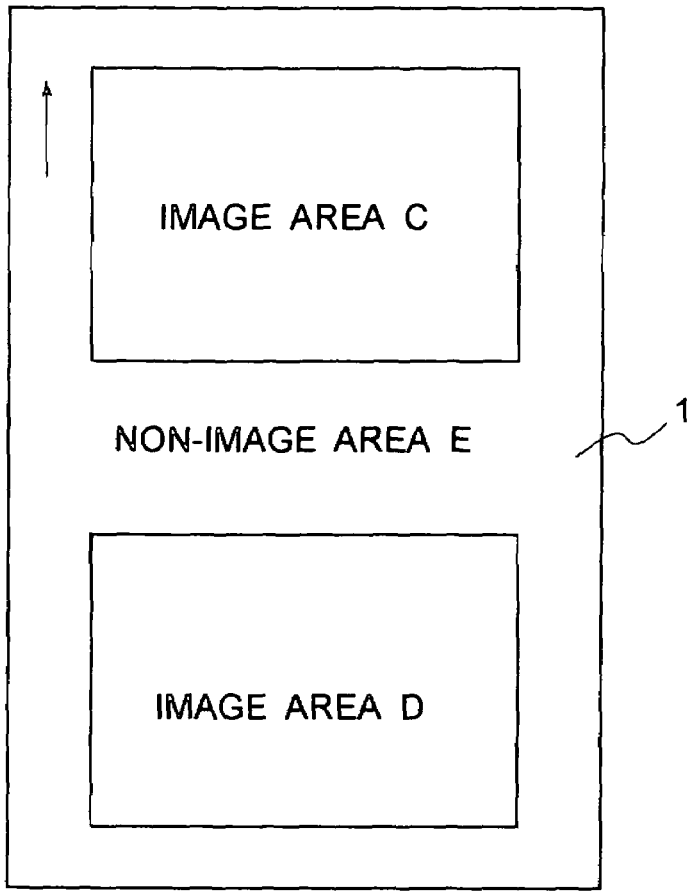
FIG. 9 is a view for illustrating image forming areas and a non-image forming area at the surface of photosensitive drum at the time of image formation.

FIG. 9 illustrates image areas C and D and a non-image area E in the case of forming an image continuously on a plurality of recording materials P. An arrow indicated in FIG. 9 represents a movement direction at the surface of the photosensitive drum 1.

A part of an operation during the continuous image formation will be described with reference to FIG. 9.

An electrostatic latent image for an ordinary image to be formed in an image area C on the photosensitive drum 1 is formed as a digital latent image. When the digital latent image reaches the developing position opposite to the developing device, the digital latent image is developed by applying the developing bias voltage A shown in FIG. 7(*a*) from the high-voltage power source to the developing sleeve of the developing device. In a period until an electrostatic latent image for a subsequent ordinary image, there is a non-image area E. In the non-image area E, control of toner replenishment is effected by forming a patch image for toner replenishment.

In the non-image area E, an analog (patch) latent image is formed at a potential between Vd (dark part potential) and a developing bias potential Vdc1 by effecting charging only to the Vd without effecting the laser exposure of the photosensitive drum 1. Thereafter, when the patch latent image reaches the developing position, the developing bias voltage A (FIG. 7(*a*)) is switched to the developing bias voltage B (FIG. 7(*b*)). The latent image is developed by the switched developing bias voltage B to provide an analog patch image. Thereafter, when a subsequent image area D reaches the developing position, the developing bias voltage B is switched again to the developing bias voltage A, a latent image of output image is developed in the image area D.

The developing bias voltage A shown in FIG. 7(*a*) has such a waveform that a pulse portion comprising a rectangular wave at a predetermined frequency (alternating voltage portion where an alternating electric field is created by applying a voltage of DC voltage biased with AC voltage to the developing sleeve 24) and a blanking portion (pause portion where a certain electric field is created by applying only the DC voltage to the developing sleeve) are alternately present. By using such a developing bias voltage A, as shown in FIG. 8(*a*), it is possible to realize a developing characteristic capable of stabilizing the resultant image density since the toner content in the developing device is not readily reflected in an image density (toner image density) formed on the photosensitive drum even if the toner content in the developing device is changed. In FIG. 8(*a*), a solid line represents an ideal image density line and broken lines represent image density lines when the toner content in the developing device is changed. Further, the blanking pulse bias voltage has such a property that high quality development is effectively performed at highlight portion with less ground fog and a resultant toner particle size distribution is stabilized even in long-term use. On the other hand, the developing bias voltage A has the above-mentioned property that the change in toner content is not readily reflected in the image density of toner to be formed, so that at this developing bias voltage A, loads applied on the toner and the carrier are liable to be increased when the developer content is controlled based on the toner image density, thus accelerating deterioration of the toner and the carrier.

On the other hand, the developing bias voltage B shown in FIG. 7(*b*) is a rectangular pulse bias voltage which repetitively has an alternating portion where an alternating electric field is created by applying a voltage of DC voltage biased with an AC voltage to the developing sleeve 24. By using such a developing bias voltage B as shown in FIG. 8(*b*), it is possible to realize such a developing characteristic that the toner content in the developing device is faithfully reflected in the image density of the toner image formed (developed). In FIG. 8(*b*), a curved, solid line represents an ideal image density curve and curved, broken lines represent image density curves when the toner content in the developing device is changed. In other words, an amount of change in toner content in the developing device is sensitively reflected in an amount of change in image density of the resultant toner image, so that the developing bias voltage B is suitable for the case of controlling the toner content, thus being liable to reduce the load on the developer. As a result, it is possible to suppress deterioration of the toner and the carrier. Further, it is also possible to alleviate the change in toner content by the change in thickness of the surface layer of the photosensitive drum since the resultant toner image density is sensitively changed by the toner content.

As described above, in this embodiment, the developing bias voltage used in development of the pitch image for toner replenishment in the non-image area during the continuous copying (image formation) sequence is changed from the developing bias voltage A which stabilizes the toner image density without causing the change in image density depending on the change in toner content to the developing bias voltage B which sensitively reflect the change in toner content in the change in image density.

Further, the patch image for toner replenishment is formed as an analog image which is switched from an output image formed as a digital image in the image area, whereby the patch image is effectively formed in the non-image area. As a result, it is possible to enhance a reliability of an output value detected by the sensor, so that the load on the toner and the carrier can be alleviated and the density of the output image in the image area can be stabilized.

Then, the two component type developer used in this embodiment will be described in detail.

Characteristics of the toner and the carrier constituting the two component type developer are shown below.

The toner includes a binder resin, a colorant, and optional colored resin particles containing another additive and colored particles to which an external additive such as colloidal silica is added externally. The toner contains a negatively chargeable polyester-based resin which is produced through a polymerization process, and may preferably have a volume-average particle size of 5–8 μm. In this embodiment, the toner has a volume-average particle size of 7.2 μm.

The carrier may, e.g., be suitably comprised of particles of surface-oxidized or non-oxidized metals such as iron, nickel, cobalt, manganese, chromium and rare-earth elements; their alloys and oxides; and ferrite. These magnetic particles may be produced through any process. The carrier has a weight-average particle size of 20–50 μm, preferably 30–50 μm, and a volume resistivity of not less than $10^7$ ohm.cm, preferably not less than $10^8$ ohm.cm. In this embodiment, the carrier has a volume resistivity of not less than $10^8$ ohm.cm. The carrier is a low specific gravity carrier which comprises a resinous magnetic carrier produced through a polymerization process after a phenolic resin binder, a magnetic metal oxide, and a non-magnetic metal oxide are mixed in a predetermined ratio. The carrier has a volume-average particle size of 35 μm, a true density of 3.6–3.7 g/cm$^3$, and a magnetization of 53 A·m$^2$/kg.

The volume-average particle size value of the toner used in this embodiment is measured by an apparatus and method described below.

Coulter counter "Model TA-II" (available from Coulter Electronics Inc.) and an interface (available from Nikkaki K.K.) and a personal computer (Model "CX-1", available from Canon K.K.) for outputting number—and volume-average particle size distributions are used as measuring apparatuses. A 1%-NaCl aqueous solution is prepared as an electrolytic solution by using a reagent-grade sodium chloride. For the measurement, 0.1 ml of a surfactant, preferably a solution of an alkylbenzenesulfonic acid salt, is added as a dispersant into 100 to 150 ml of the electrolytic solution, and 0.5–50 mg of sample toner particles (or a sample toner) are added thereto. The resultant dispersion of the sample in the electrolytic solution is subjected to a dispersion treatment for ca. 1–3 minutes by means of an ultrasonic disperser, and then subjected to measurement of particle size distribution in the range of 2–40 μm by using the above-mentioned apparatus (Coulter counter TA-II) with a 100 μm-aperture to obtain a volume-basis distribution and a number-basis distribution. From the volume-basis distribution, a volume-average particle size is calculated.

The volume resistivity of the carrier used in this embodiment is measured by the following method.

By using a sandwich-type cell including a pair of measuring electrodes (electrode area: 4 cm$^2$, spacing therebetween: 0.4 cm), a voltage E (V/cm) is applied between the electrodes under application of a load of 1 kg on one of the electrodes. A volume resistivity is determined from a current passing through the circuit at that time.

The magnification (A·m$^2$/kg) of the carrier is determined by obtaining a strength of magnetization of a cylindrically packed carrier in an external magnetic field of 79.6 kA/m (1000 oersted (Oe)) by using an oscillating magnetic field type magnetic property automatically recording apparatus.

Incidentally, the developer used in the image forming apparatus in this embodiment has a lifespan of 5000 sheets (copies).

In this embodiment, a correction of analog patch contrast is effected on the basis of a detected amount of current passing through the photosensitive drum 1. More specifically, referring to FIG. 10, the correction of patch contrast is effected by hanging only the patch development potential while keeping the patch charging potential at a constant level. Specific values described below are merely exemplary values and those adoptable in the present invention are not limited thereto.

In a specific example of this embodiment, a determination method of correction timing of the patch contrast will be described below.

Figure 10:
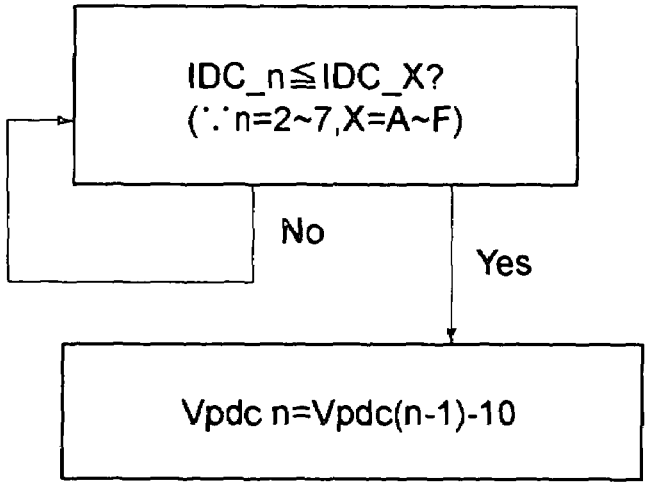
FIG. 10 is a flowchart of developing voltage correction in Embodiment 1 appearing hereinafter.

First, referring to FIG. 10, thickness values CT_2 to CT_7 when the patch contrast correction is performed are determined and converted into current values based on the above-described current value-surface layer thickness table (FIG. 5). The resultant current values (of photosensitive drum) IDC_2 to DC_7 are used as threshold values for correction timing.

At the time of an initial setting of the image forming apparatus or replacement of photosensitive drum, the above-described thickness detection sequence is continuously effected three times, and an average current (IDC_1) of three detection results is taken as an initial current value of the photosensitive drum.

The resultant current value IDC_1 is converted into a surface layer thickness value based on the curved value-surface layer thickness table described above to obtain an initial surface layer thickness value CT_1.

From the thus obtained CT_1, surface layer thickness values CT_2, CT_3, CT_4, CT_5, CT_6 and CT_7 are determined as correction points for patch contrast. In this embodiment, these values CT_2 to CT_7 are taken at a spacing between adjacent two points of −3 μm. For example, if CT_1=30 μm, CT_2 to CT_7 are 27 μm, 24 μm, 21 μm, 18 μm, 15 μm and 12 μm, respectively.

In this embodiment, the number of correction points is 6 (CT_2 to CT_7) and this is sufficient to correct the patch contrast within the lifespan of the photosensitive drum 1.

From the CT_2 to CT_7, corresponding current values ID_2 to ID_7 are determined and stored in the back-up memory. As described above, the current values ID_2 to ID_7 are used as threshold values for effecting the patch contrast correction. The patch contrast correction is effected when the detected current value exceeds these threshold values.

In use of the image forming apparatus, the latest 3 detection results of the surface layer thickness detection sequence are stored, and when an average value IDC_A of these 3 detection results satisfies IDC_A≧IDC_2, an initial toner patch developing potential Vpdc_1 is corrected to a predetermined value (−10 V in this embodiment) to obtain Vpdc_2.

After completion of the above-described patch contrast correction, in subsequent use of the image forming apparatus, the latest 3 detection results of the surface layer thickness detection sequence are stored, and when an average value IDC_B of these 3 detection results satisfies IDC_B≧IDC_3, the toner patch developing potential Vpdc_2 is corrected to a predetermined value (−10 V in this embodiment) to obtain Vpdc_3.

In a similar manner, when average current values IDC_C to IDC_F of the respective latest 3 detection results and the threshold values for detected current values IDC_4 to IDC_7 satisfy the following relationships:

IDC_C≧IDC_4,

IDC_D≧IDC_5,

IDC_E≧IDC_6,

IDC_F≧IDC_7, the respective toner patch developing potentials are corrected to obtain Vpdc_4 to Vpdc_7.

As described above, depending on the detected thickness of the surface layer of the photosensitive drum 1, the patch contrast is corrected.

Figure 11:
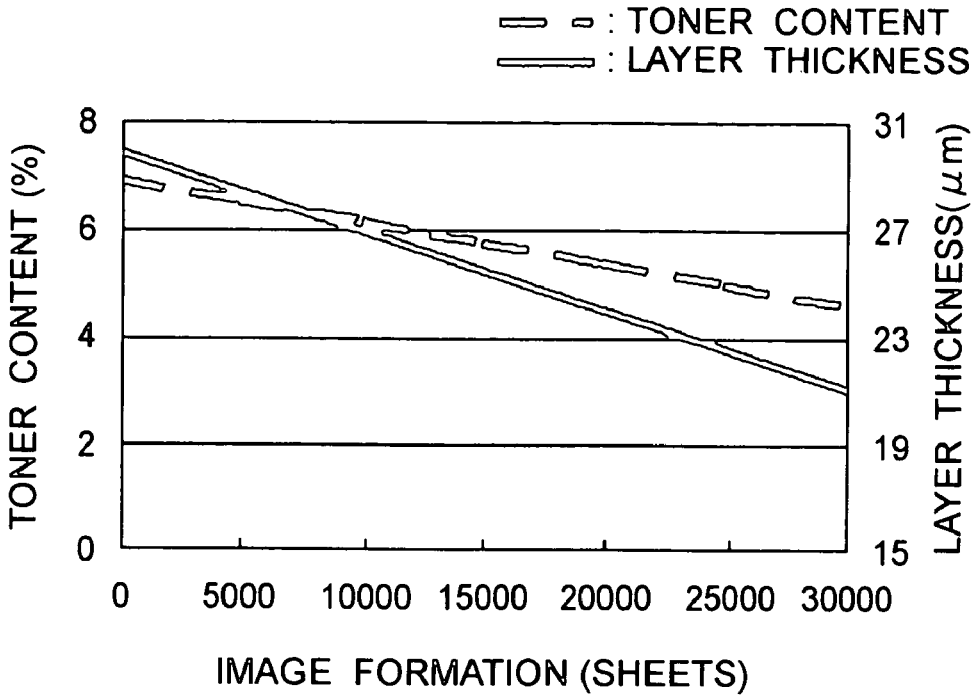
FIG. 11 is a graph showing a relationship between the progression of a toner density and that of a change in surface layer thickness when correction of a patch developing voltage is not effected.

In the case where the image forming apparatus used in this embodiment is ordinarily used for forming a black (monochromatic) image without effecting the above-described patch contrast correction, the results are shown in FIG. 11.

As shown in FIG. 11, although an initial toner content (i.e., a weight percentage of toner to the sum of toner and carrier) is 7%, the toner content was gradually lowered with abrasion of the surface layer of the photosensitive drum 1, thus resulting in 4.5% after 30000 sheets of image formation (copying). Due to this considerable lowering in toner content, in a subsequent image forming operation, various image failures, such as roughening, carrier attachment and lowering in image density, were cased to occur.

Figure 12:
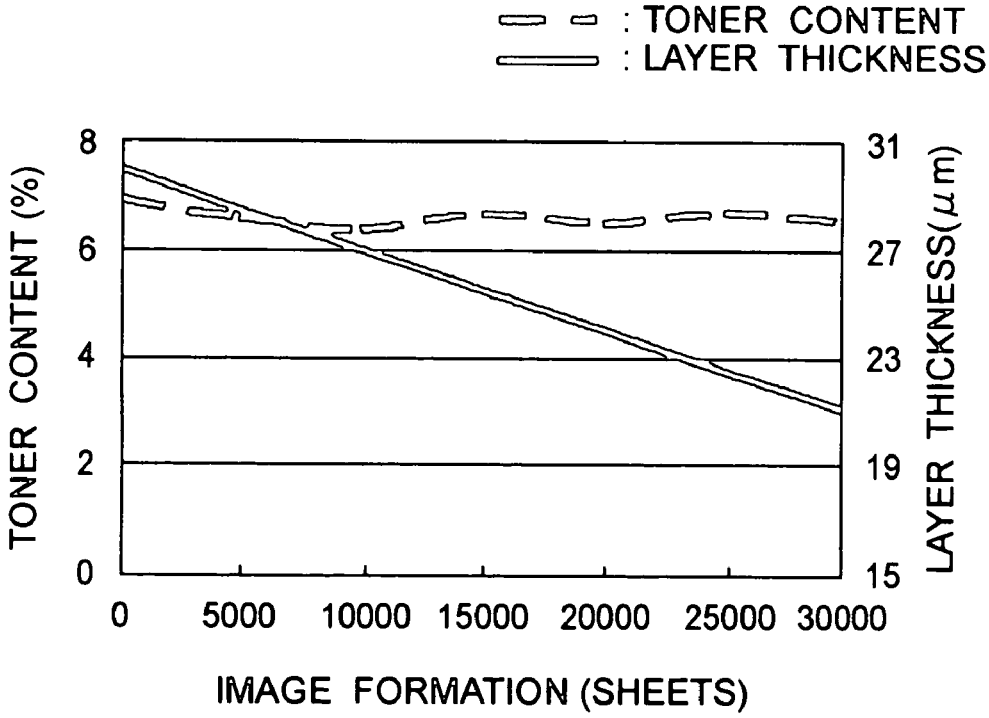
FIG. 12 is a graph showing a relationship between the progression of a toner density and that of a change in surface layer thickness when correction of a patch developing voltage is effected.

On the other hand, the results of the image formation in which the patch contrast correction is effected are shown in FIG. 12. Referring to FIG. 12, the initial toner content of 7% was not substantially lowered even when abrasion of the photosensitive drum surface layer proceeded, and was 6.5% after 30000 sheets of image formation.

As described above, even when the thickness of the surface layer of the photosensitive drum 1 is changed, the surface layer thickness of the photosensitive drum 1 is accurately detected and based on the detected results, the toner is supplied from the toner container 23 into the developing device 22, so that it is possible to always effect stable image formation without changing the toner content.

In this embodiment, when the analog patch contrast is corrected on the basis of detection results of the thickness of surface layer, only the patch developing potential is changed while keeping the patch charging material at a constant level. However, in the present invention, it is possible to change the patch charging potential while keeping the patch developing potential at a constant level or to change both the patch charging potential and the patch developing potential. Further, the image forming apparatus of the present invention is not particularly limited to that of this embodiment but is applicable to image forming apparatuses having various structures. For example, the image forming apparatus of the present invention is applicable to an image forming apparatus of also-called in-line-type wherein each of a plurality of photosensitive drums as image bearing members for plural colors is provided with a corresponding developing apparatus at a process station, which is disposed opposite to a transfer medium, thus effecting image formation. Further, the image forming apparatus of the present invention is also applicable to a transfer type image forming apparatus wherein a toner image is directly transferred from a photosensitive drum to a recording material conveyed by a recording material carrying member, such as a conveyance belt.

<Embodiment 2>

In this embodiment, an image forming process is substantially identical to that of Embodiment 1, so that repetitive explanation will be appropriately omitted.

In Embodiment 1, the thickness values CT_2 to CT_7 of the photosensitive drum surface layer for effecting the patch contrast correction were first determined and then converted into the current value IDC_2 to IDC_7 on the basis of the current amount-surface layer thickness table, and the current values IDC_2 to IDC_7 were used as the threshold values.

On the other hand, in this embodiment, without using the current value-surface layer thickness table, threshold values IDC_II to IDC_VII for detection current values at the time of patch contrast correction are directly determined based on current values detected at the time of initial setting of the image forming apparatus or replacement of the photosensitive drum 1.

Figure 13:
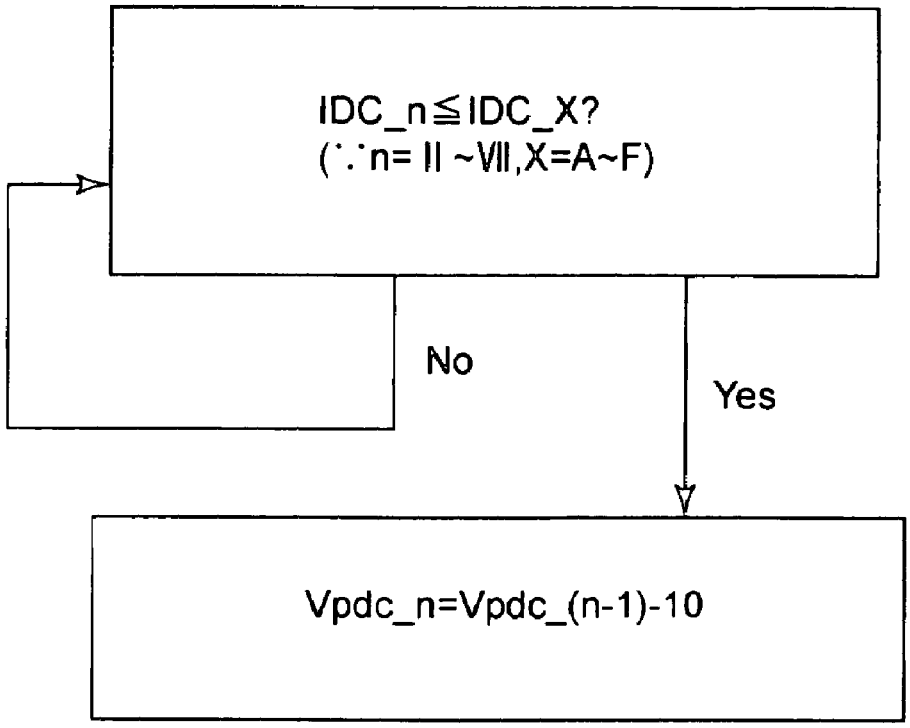
FIG. 13 is a flowchart of developing voltage correction in Embodiment 2.

More specifically, referring to FIG. 13, similarly as Embodiment 1, the surface layer thickness detection sequence is continuously effected three times at the time of initial setting of the image forming apparatus or replacement of the photosensitive drum 1, and an average current (DC_1) of three detection results is taken as an initial current value of the photosensitive drum.

From the resultant initial current value IDC_1, current values IDC_II to IDC_VII are directly determined as correction points for patch contrast. In this embodiment, these values IDC_II to IDC_VII are taken at an interval between adjacent two points of +3 μA. For example, if IDC_1=35 μA, IDC_II to IDC_VII are 38 μA, 41 μA, 43 μA, 46 μA, 49 μA and 52 μA, respectively.

In use of the image forming apparatus, the latest 3 detection results of the surface layer thickness detection sequence are stored, and when an average value IDC_A of these 3 detection results satisfies IDC_A≧IDC_II, an initial toner patch developing potential Vpdc_1 is corrected to a predetermined value (−10 V in this embodiment) to obtain Vpdc_2.

After completion of the above patch contrast correction, in subsequent use of the image forming apparatus, the latest 3 detection results of the surface layer thickness detection sequence are stored, and when an average value IDC_B of these 3 detection results satisfies IDC_B≧IDC_III, the toner patch developing potential Vpdc_2 is corrected to a predetermined value (−10 V in this embodiment) to obtain Vpdc_3.

In a similar manner, when average current values IDC_C to IDC_F of the respective latest 3 detection results and the threshold values for detected current values IDC_IV to IDC_VII satisfy the following relationships:

IDC_C≧IDC_IV,

IDC_D≧IDC_V,

IDC_E≧IDC_VI,

IDC_F≧IDC_VII, the respective toner patch developing potentials are corrected to obtain Vpdc_4 to Vpdc_7.

As described above, depending on the detected thickness of the surface layer of the photosensitive drum 1, the patch contrast is corrected.

As described above, also in this embodiment, even when the thickness of the surface layer of the photosensitive drum 1 is changed, the surface layer thickness of the photosensitive drum 1 is accurately detected and based on the detected results, the toner is supplied from the toner container 23 into the developing device 22, so that it is possible to effect always stable image formation without changing the toner content.

<Embodiment 3>

In this embodiment, an image forming process is substantially identical to that of Embodiments 1 and 2, so that repetitive explanation will be appropriately omitted.

In Embodiments 1 and 2, the analog patch contrast is corrected based on the detection results of the surface layer thicknesses.

On the other hand, in this embodiment, on the basis of the detection results of the surface layer thicknesses, a target signal value for a toner patch content is corrected.

Figure 14:
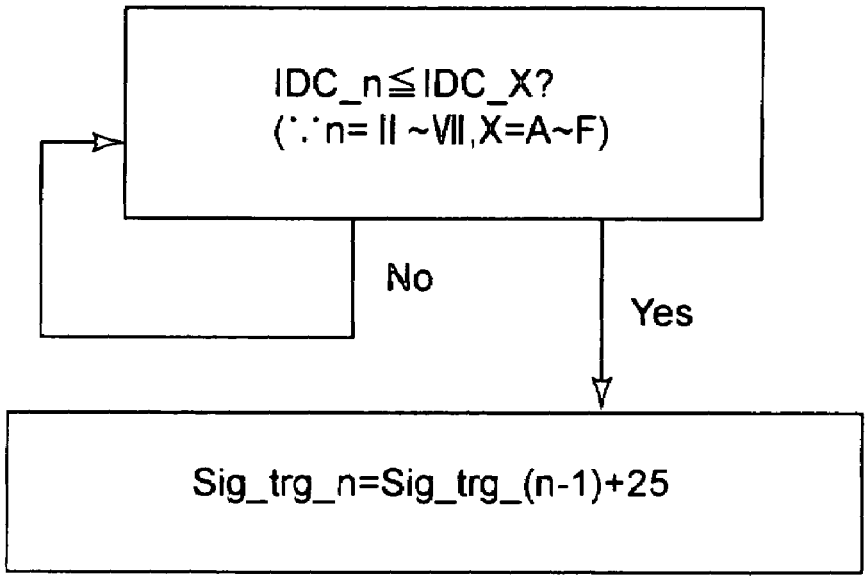
FIG. 14 is a flowchart of developing voltage correction in Embodiment 3.
Figure 15:
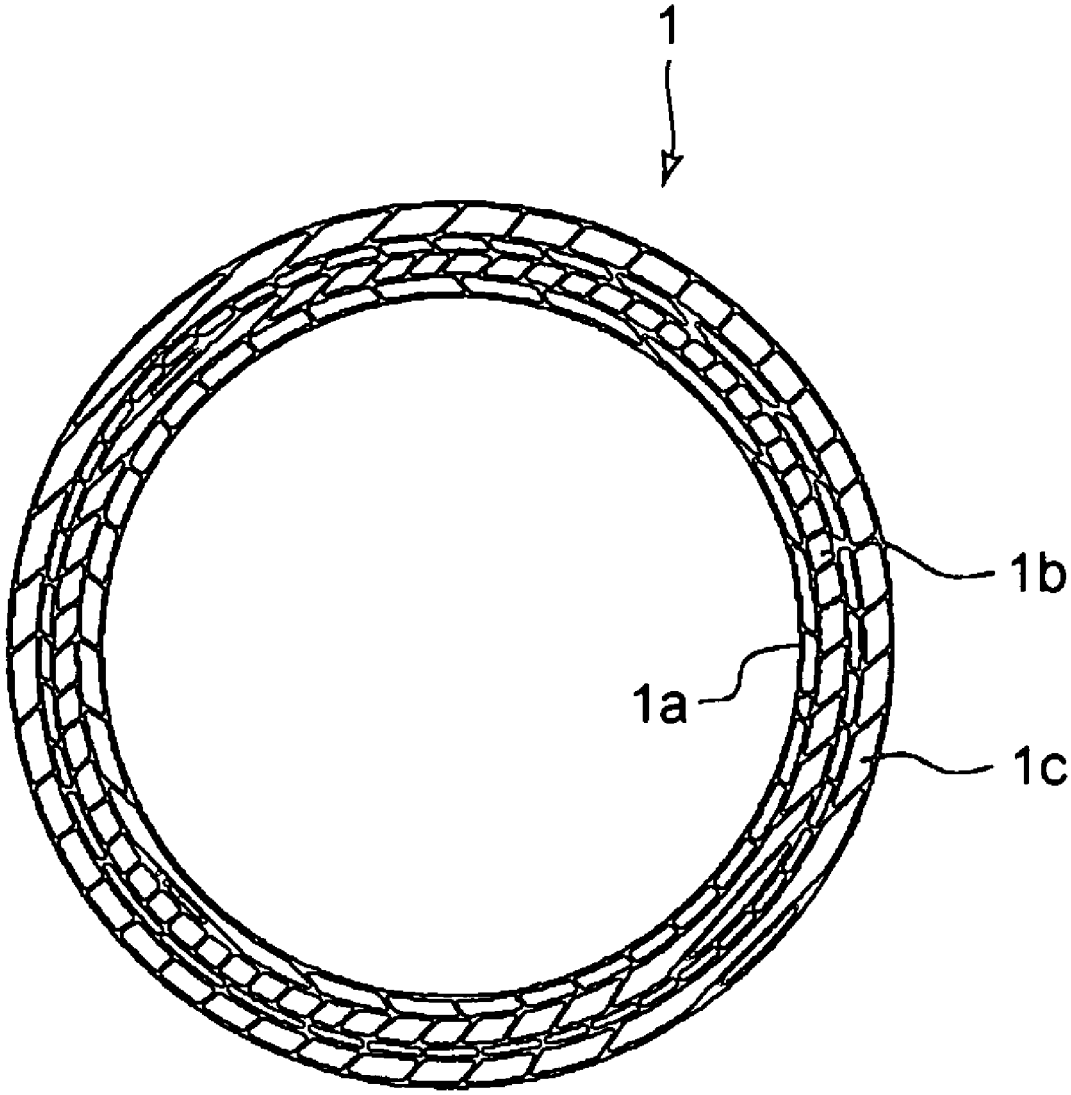
FIG. 15 is a longitudinal sectional view showing an embodiment of a layer structure of a photosensitive drum.

More specifically, referring to FIG. 14, similarly as Embodiment 2, the surface layer thickness detection sequence is continuously effected three times at the time of initial setting of the image forming apparatus or replacement of the photosensitive drum 1, and an average current (IDC_1) of three detection results is taken a an initial current value of the photosensitive drum.

From the resultant initial current value IDC_1, current values IDC_II to IDC_VII are directly determined as correction points for patch contrast. In this embodiment, these values IDC_II to IDC_VII are taken at an interval between adjacent two points of +3 μA. For example, if IDC_1=35 μA, IDC_II to IDC_VII are 38 μA, 41 μA, 43 μA, 46 μA, 49 μA and 52 μA, respectively.

In use of the image forming apparatus, the latest 3 detection results of the surface layer thickness detection sequence are stored, and when an average value IDC_A of these 3 detection results satisfies IDC_A≧IDC_II, an initial toner patch target signal value Sig-trg-I is corrected to a predetermined value (+25 level in this embodiment) to obtain Sig-trg-II.

After completion of the above patch contrast correction, in subsequent use of the image forming apparatus, the latest 3 detection results of the surface layer thickness detection sequence are stored, and when an average value IDC_B of these 3 detection results satisfies IDC_B≧IDC_III, the toner patch target signal value Sig-trg-II is corrected to a predetermined value (+25 level in this embodiment) to Sig-trg-III.

In a similar manner, when average current values IDC_C to IDC_F of the respective latest 3 detection results and the threshold values for detected current values IDC_IV to IDC_VII satisfy the following relationships:

IDC_C≧IDC_IV,

IDC_D≧IDC_V,

IDC_E≧IDC_VI,

IDC_F≧IDC_VII, the respective toner patch target signal value are corrected to obtain Sig-trg-IV to Sig-trg-VII.

As described above, depending on the detected thickness of the surface layer of the photosensitive drum 1, the target signal value for the toner patch content is corrected.

As described above, also in this embodiment, even when the thickness of the surface layer of the photosensitive drum 1 is changed, the surface layer thickness of the photosensitive drum 1 is accurately detected and based on the detected results, the toner is supplied from the toner container 23 into the developing device 22, so that it is possible to effect always stable image formation without changing the toner content.

What is claimed is:

1. An image forming apparatus, comprising:

an image bearing member including a surface layer;

electrostatic image forming means for forming an electrostatic image on said surface layer;

developing means, containing at least toner and a carrier, for developing the electrostatic image;

density measuring means for measuring a density of the developed electrostatic image;

layer thickness measuring means for measuring a thickness of the surface layer; and adjusting means for adjusting toner content in said developing means, wherein said adjusting means adjusts the toner content on the basis of the thickness of said surface layer measured by said layer thickness measuring means, wherein said electrostatic image forming means includes means for electrically charging the surface layer, wherein said layer thickness measuring means measures the thickness of the surface layer by measuring a current passing through said image bearing member via said electrostatic image forming means, wherein the electrostatic image to be formed at the time of a toner content adjustment is formed in a non-image area of said image bearing member and developed by said developing means which is supplied with a voltage so that a first voltage is applied to the non-image area and a second voltage is applied to an image forming area, and wherein an amount of change in density of the developed electrostatic image to an amount of change in a toner concentration at the time of applying the first voltage is larger than an amount of change in density of the developed electrostatic image to an amount of change in a toner concentration at the time of applying the second voltage.

* * * * *

UNITED STATES PATENT AND TRADEMARK OFFICE

CERTIFICATE OF CORRECTION

PATENT NO. : 7,013,095 B2
APPLICATION NO. : 10/790838
DATED : March 14, 2006
INVENTOR(S) : Yusuke Ishida It is certified that error appears in the above-identified patent and that said Letters Patent is hereby corrected as shown below:

ON TITLE PAGE, col. 1

UNDER REFERENCES CITED. ITEM (30):

"2003/002593" should read --2003-062593--.

COLUMN 1:

Line 25, "are caused" should read --each are caused--;
Line 44, "changed" should read --is changed--; and
Line 64, "which is" should read --is--.

COLUMN 2:

Line 4, "such" should be deleted; and
Line 55, "photosensitive" should read --the photosensitive--.

COLUMN 3:

Line 14, after "bearing member." should read --bearing member is changed.--;
Line 20, "such" should be deleted;
Line 32, "FIG. 1 show" should read --FIG. 1 shows--;
Line 47, "means 3," should read --means) 3,--; and
Line 67, "preven" should read --preven- --.

COLUMN 5:

Line 23, "transfer roller 16" should read --transfer bias (voltage) to the secondary transfer roller 16--; and
Line 33, "formed a a" should read --formed as a--.

COLUMN 6:

Line 4, "Wen the' should red --When the--; and
Line 58, "controlled a" should read --controlled as--.

COLUMN 7:

Line 10, "charged" should read --charges--.

UNITED STATES PATENT AND TRADEMARK OFFICE

CERTIFICATE OF CORRECTION

PATENT NO. : 7,013,095 B2
APPLICATION NO. : 10/790838
DATED : March 14, 2006
INVENTOR(S) : Yusuke Ishida It is certified that error appears in the above-identified patent and that said Letters Patent is hereby corrected as shown below:

COLUMN 8:

Line 17, should be deleted;
Line 18, “referred to a” should read --referred to as a--;
Line 49, “becomes” should read --become--; and
Line 52, “such a” should read --such as--.

COLUMN 9:

Line 21, “value):” should read --value);--.

COLUMN 10:

Line 47, “reflect” should read --reflects--.

COLUMN 12:

Line 10, “]DC_2 to DC_7” should read --IDC_2 to IDC_7--;
Line 12, “photosensitive” should read --the photosensitive--; and
Line 31, “from the” should read --from the values--.

COLUMN 13:

Line 16, “cased” should read --caused--; and
Line 43, “also-called” should read --a so-called--.

COLUMN 14:

Line 9, “(DC_I)” should read --(IDC_1)--.

UNITED STATES PATENT AND TRADEMARK OFFICE

CERTIFICATE OF CORRECTION

PATENT NO. : 7,013,095 B2
APPLICATION NO. : 10/790838
DATED : March 14, 2006
INVENTOR(S) : Yusuke Ishida It is certified that error appears in the above-identified patent and that said Letters Patent is hereby corrected as shown below:

COLUMN 15:

Line 9, "taken a an" should read --taken as an—; and
Line 43, "value are" should read --values are--.

Signed and Sealed this

Twenty-fourth Day of October, 2006

JON W. DUDAS
*Director of the United States Patent and Trademark Office*